US005203597A

United States Patent [19]

Wheelock

[11] Patent Number: 5,203,597

[45] Date of Patent: Apr. 20, 1993

[54] UNIVERSAL LOCK

[76] Inventor: Karl E. Wheelock, 113 Netural Ct., Syracuse, N.Y. 13208

[21] Appl. No.: 720,958

[22] Filed: Jun. 25, 1991

[51] Int. Cl.[5] ..... E05B 65/52

[52] U.S. Cl. ..... 292/258; 292/DIG. 71; 292/288

[58] Field of Search ..... 292/258, 262, 259, 350, 292/288, 251, 149, DIG. 46, 338, 339, 305, DIG. 71

[56] References Cited

U.S. PATENT DOCUMENTS

| | | | |
|---|---|---|---|
| 640,057 | 12/1899 | Weston | 292/259 |
| 1,425,515 | 8/1922 | Ellis | 292/288 |
| 2,003,856 | 6/1935 | Gimbel | 292/258 X |
| 2,903,152 | 9/1959 | Kuo | 292/251 X |
| 2,924,476 | 2/1960 | Deane | 292/288 X |
| 3,665,736 | 5/1972 | Wilson | 292/259 R X |
| 4,300,796 | 11/1981 | Lane | 292/339 |

*Primary Examiner*—Richard E. Moore
*Attorney, Agent, or Firm*—John P. Halvonik

[57] ABSTRACT

The invention is to a safety device which can be fitted onto existing doors to prevent the inadvertent usage or opening of various household devices. These can be for example, refrigerators, microwave ovens, VCRs, etc. The device typically prevents small children from opening the door and/or using these devices without supervision. The device comprises a set of telescopically engaging members which are held tightly together over the handle of the door by a thumbscrew.

11 Claims, 1 Drawing Sheet

3
4

4
3
1
2

5

UNIVERSAL LOCK

BACKGROUND OF THE INVENTION

The invention relates to the field of safety in preventing the inadvertent opening of household devices. As most everyone knows, small children may be attracted to e.g.: the refrigerator the microwave, etc. and wish to play with them. The doors to these devices may be a source of amusement to the children but also a source of danger by suffocation, microwave radiation, viewing of inappropriate subject matter, etc.

The invention of the present application is to prevent such uses by engaging the telescoping members of the apparatus over the handles of the household appliances to prevent the handle from being opened when children are near. The members are held together through the use of a thumbscrew which offer a quick, safe, and convenient means to lock up the refrigerator.

DESCRIPTION OF THE PRIOR ART

While there are devices available that are designed to prevent the unauthorized entry of e.g.: the refrigerator, none that applicant is aware of are of the same tubular construction as his. Moreover, none can be fit so easily and readily over the doors of most household items. The device is designed for safe, cheap, quick, simple prevention of unauthorized entry to these appliances.

SUMMARY OF THE INVENTION

The invention of the present application comprises telescoping tubes which are bent at right angles to one another. The near ends are held together through a thumbscrew means and the far ends of each tube face one another. These facing ends are covered with a frictional material. This frictional material engages the surface of the front and back of the appliance and secures the tubes tightly to one another through the thumbscrew. One portion of the device is placed through the handle and the other secured to the back wall of the device (or the wall that is opposite the handle).

It is the object of this invention to provide a simple and efficient means of preventing entry to the refrigerator by small children.

Another objective is to prevent the unauthorized use of the VCR by children.

Another objective is to prevent the unauthorized use of the microwave and other household appliances by small children.

It is the object of this invention to prevent the opening of the handle of a household device through the use of telescoping members tightly held over the surface of the front and rear of the appliance.

Other advantages of the invention should be readily apparent to those skilled in the art once the invention has been described.

DESCRIPTION OF THE PREFERRED EMBODIMENT

Figures 1, 2, 3:
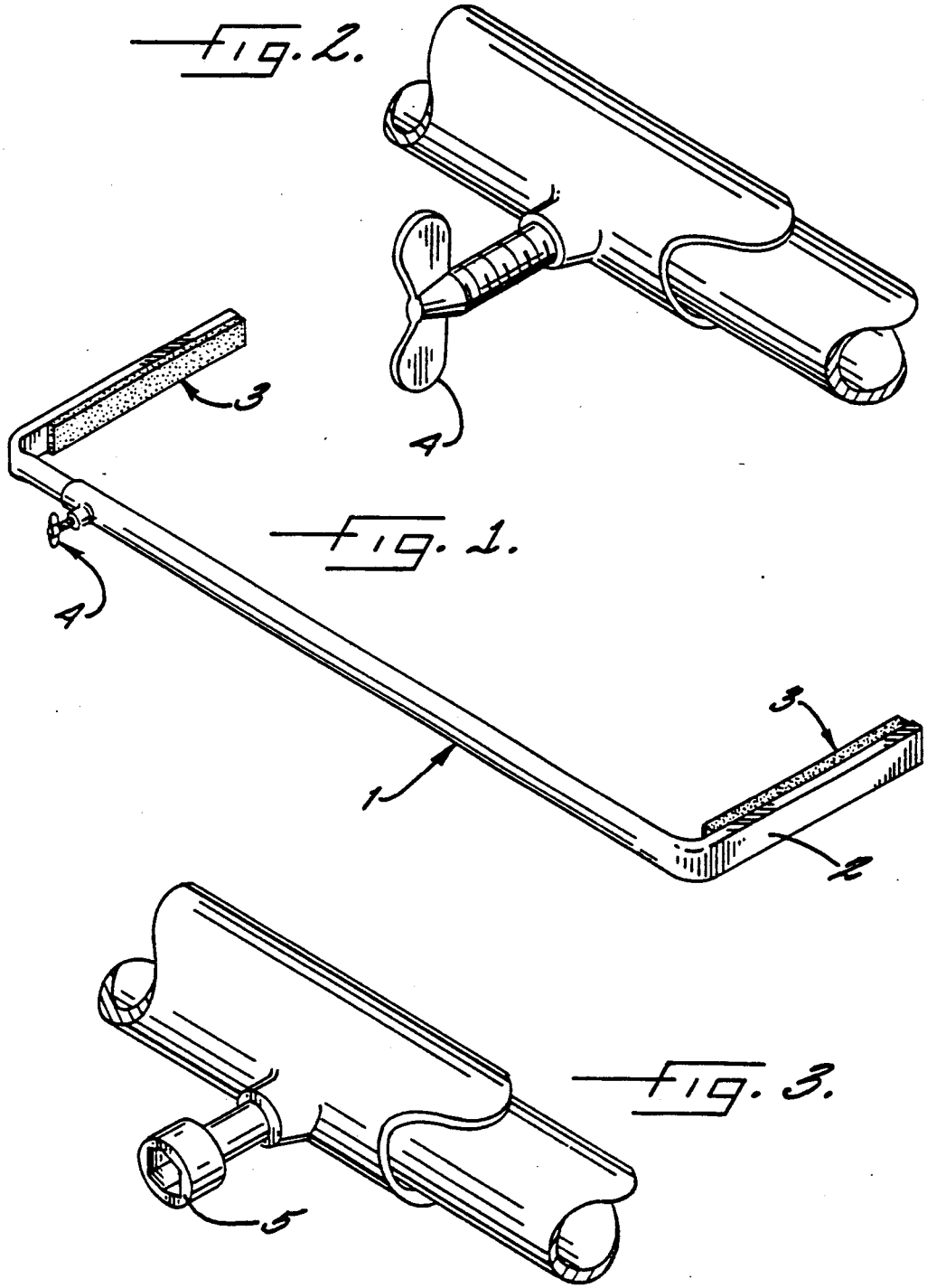
FIG. 1 shows the overall construction of the apparatus.
FIG. 2 shows detail of thumbscrew and tubes.
FIG. 3 shows alternate Allen-type screw head.

The basic parts of the device are the two telescoping tubular members. The members are hollow and are built with one larger than the other so that they may fit into one another so that they may be tightly held together by a thumbscrew means.

The members are preferably hollow, and of high impact plastic construction. Other materials are within the scope of the invention and include other metals, e.g. aluminum, etc.

There is a hole in the larger one of the members near the end of it that is secured into the other member. This hole serves to allow the thumbscrew 4 to fit through the larger member and against the smaller member which is fit telescopically into the larger member. These portions that are secured together are known as the front portions 1 to distinguish them from those portions of the members that contact the sides of the appliance known as the side portions 2.

The two tubes are bent at right angles to one another so that the side portions parallel one another and the front portions, telescoped into one another are co-linear, see FIG. 1. The inner surface of the side portions thus face one another, it is these surfaces which are covered with the frictional material 3. It is preferred that the material be like, foam rubber or some other material that can be readily held by friction against the smooth surfaces typical of the front and back walls of the VCR, microwave, refrigerator, etc.

One of the front portions is placed on the front surface of the appliance underneath or over the handle and the side portion is placed on the side of the appliance. Placing the end over or under the handle prevents it from opening when youngsters are around. The handle is relatively immobile when the apparatus is secured to the walls of the appliance.

As the two pieces telescope into one another, the distance between the free ends may be varied by the telescoping movement. This allows one to set a distance between the two that will set the inner frictional surfaces tightly against those of the applicance. Once that distance for a tight fit is determined, the members are locked into place by the thumbscrew means. The members are now tightly held against the front and back walls of the appliance with one of the members over or under the handle to prevent the door of the appliance from opening.

It is preferred that the members be of a length that would enable the distance between the free ends to be varied from 12–40 inches and with about 15–30 inches in variance preferred.

Note that either member could be engaged with either front or back wall of the appliance. For that matter, either part of the member, the side portion or the front portion may go over the handle. The thumbscrew means may use an Allen head 5 construction so that older children (say over 5 years old) will not be able to undo the thumbscrew through sheer force.

I claim:

1. A safety attachment for preventing inadvertent opening of the handles of household devices for placing around such devices comprising: first and second tubular members, each of said tubular members being of hollow material, having substantially smooth surfaces, and being bent at about a 90 degree angle to form a side portion and a front portion, said members of dissimilar diameter for telescoping movement, said member of larger diameter having a threaded screw in movable connection with said member of smaller diameter for holding said members tightly together, said threaded screw attached to the front portion of said member of larger diameter, each of said side portions having a strip of frictional material for engaging with the sides of said devices.

2. The apparatus of claim 1 wherein said strip of frictional material is made of foam rubber.

3. The apparatus of claim 2 where in said frictional surface is about 3–5 inches in length.

4. The apparatus of claim 3 wherein said tubular members are made of aluminum.

5. The apparatus of claim 4 wherein said tubular members are about 15–30 inches in length and said bent portions are near said side portions of each of said members.

6. The apparatus of claim 5 wherein said threaded screw is a thumbscrew.

7. The apparatus of claim 5 wherein said threaded screw has an Allen-type head.

8. The apparatus of claim 3 wherein said tubular members are made of high impact plastic.

9. The apparatus of claim 8 wherein said tubular members are about 15–30 inches in length and said bent portion is near said side portion of each of said members.

10. The apparatus of claim 9 wherein said threaded screw is a thumbscrew.

11. The apparatus of claim 9 wherein said threaded screw has an Allen-type head.

* * * * *